United States Patent [19]

Takeda et al.

[11] Patent Number: 5,022,455

[45] Date of Patent: Jun. 11, 1991

[54] METHOD OF PRODUCING ALUMINUM BASE ALLOY CONTAINING SILICON

[75] Inventors: Yoshinobu Takeda; Yusuke Odani; Tetsuya Hayashi; Toshihiko Kaji; Yoshiaki Itoh, all of Hyogo, Japan

[73] Assignee: Sumitomo Electric Industries, Ltd., Osaka, Japan

[21] Appl. No.: 559,634

[22] Filed: Jul. 30, 1990

[30] Foreign Application Priority Data

Jul. 31, 1989 [JP] Japan ..... 1-199968
Aug. 24, 1989 [JP] Japan ..... 1-218231

[51] Int. Cl.[5] ..... B22D 23/00

[52] U.S. Cl. ..... 164/46; 427/196; 427/426

[58] Field of Search ..... 164/46; 427/196, 426

[56] References Cited

U.S. PATENT DOCUMENTS

| | | | |
|---|---|---|---|
| 1,654,509 | 12/1927 | Claus | 164/46 X |
| 3,670,400 | 6/1972 | Singer | 164/46 X |
| 3,797,101 | 3/1974 | Bauer | 164/46 X |
| 3,833,983 | 9/1974 | Baker et al. | 164/46 X |
| 3,899,820 | 8/1975 | Read et al. | 164/46 X |
| 4,674,554 | 6/1987 | Feest | 164/46 |

FOREIGN PATENT DOCUMENTS

| | | | |
|---|---|---|---|
| 63-295053 | 12/1988 | Japan | 164/46 |
| 64-57965 | 3/1989 | Japan | 164/46 |

OTHER PUBLICATIONS

American Aluminum Standards (AA/ASTM) Designation: B 209M-86, Mar. 1986, pp. 214-248.

*Primary Examiner*—J. Reed Batten, Jr.
*Attorney, Agent, or Firm*—W. G. Fasse; D. H. Kane, Jr.

[57] ABSTRACT

An aluminum alloy is melted and sprayed from a nozzle. Solid particles of silicon are sprayed by gas jet simultaneously with spraying of the aluminum alloy. Both the sprayed aluminum alloy and the sprayed solid particles of silicon are deposited and cooled.

5 Claims, 2 Drawing Sheets

METHOD OF PRODUCING ALUMINUM BASE ALLOY CONTAINING SILICON

BACKGROUND OF THE INVENTION

1. Field of the Invention

The present invention relates to a method of producing an aluminum base alloy containing silicon.

2. Description of the Background Art

An aluminum base alloy containing silicon is generally produced by ingot metallurgy (I/M) method of adding and fusing silicon into a molten aluminum alloy, a pre-mixed powder extrusion method of mixing silicon particles with aluminum alloy particles and extruding into a shape the pre-mixed powder via a powder metallurgy method.

In the ingot metallurgy (I/M) method, however, larger primary crystals of silicon are crystallized and segregated in the aluminum base alloy, whose strength is reduced and machinability is deteriorated as the result. In the pre-mixed powder extrusion method, on the other hand, the aluminum alloy particles and the silicon metal particles are insufficiently joined at the interfaces therebetween, and hence the as-formed aluminum base alloy is inferior in strength and toughness. Further, less stress is transferred due to insufficient bonding at the interfaces, and hence reduction in the thermal expansion coefficient is less than that of expected.

Such problems can be solved by a powder extrusion method of pre-alloy powder in which pre-alloy powder is prepared via atomizing a molten Al-Si alloy, and extruding into a shape. According to this method, it is possible to obtain an aluminum base alloy which has high strength, toughness and machinability and a low thermal expansion coefficient.

However, when an aluminum base alloy containing high concentration of silicon is produced by such an alloy powder extrusion method, the melting temperature of the aluminum alloy is raised up as the silicon content is increased, and hence it is necessary to heat the aluminum alloy to a high temperature in order to melt the same. When alloy powder is prepared by the atomization method, therefore, a problem such as plugging of a nozzle is caused during atomization, leading to problems in productability and economics.

Also when solid particles such as graphite particles are dispersed in an aluminum base alloy containing silicon, the conventional I/M method and powder metallurgy (P/M) method cause the following problems:

In the I/M method, solid particles which have different specific gravity from the molten alloy are added into the molten alloy. Thus, the solid particles are segregated in the molten alloy due to the difference in specific gravity, and hence it is impossible to homogeneously disperse the solid particles in the aluminum base alloy. In order to solve such a problem, proposed is a method of plating the surfaces of graphite particles with nickel and mixing with a molten alloy, for example. If graphite particles are thus plated, however, the cost is significantly increased to cause a problem in economics. In addition, matrix strength is reduced due to a slow solidification rate. When bare graphite particles are employed, further, $Al_4C_3$ is generated at interfaces between the particles and the matrix of the aluminum alloy, to reduce toughness of the as-formed aluminum base alloy.

In the P/M method, graphite particles and aluminum alloy particles are mixed up and then consolidated.

Thus, bonding strength between the graphite particles and the matrix is made insufficient, leading to reduction in strength and toughness of the aluminum base alloy. Further, the graphite particles are deformed into flaky shape by shear breakage layer by layer during plastic working, to reduce bonding strength between aluminum alloy particles.

SUMMARY OF THE INVENTION

An object of the present invention is to provide a method of producing an aluminum base alloy containing silicon, which is excellent in physical strength and toughness, through simple steps at a low cost.

Another object of the present invention is to provide a method of producing an aluminum base alloy containing silicon, which can homogeneously disperse graphite particles, suppress reaction between the graphite particles and an aluminum alloy matrix, and improve bonding strength between the graphite particles and the aluminum alloy matrix.

The method of the present invention of producing an aluminum base alloy containing silicon comprises the steps of melting an aluminum alloy, spraying the molten aluminum alloy from a nozzle, spraying solid particles of silicon by gas jet simultaneously with spraying of the aluminum alloy, and depositing and cooling both the sprayed aluminum alloy and the sprayed solid particles of silicon.

According to the present invention, the silicon particles sprayed by the air current is preferably not more than 10 $\mu$m in mean particle size, in consideration of machinability of the alloy.

The spray forming method of spraying solid particles and molten particles of an alloy and forming the same is a conventional technique, while the solid particles sprayed in the conventional spray forming method are ceramic particles which are infusible in an alloy such as SiC, $Al_2O_3$ or the like. According to the present invention, silicon which is fusible in an aluminum alloy is deliberately sprayed and mixed in the form of solid particles.

According to the first aspect of the present invention, produced is an aluminum base alloy which contains at least 25 percent by weight of silicon. According to the first aspect, the method of the present invention comprises the steps of melting an aluminum alloy containing silicon in an amount not generating large primary crystals of silicon in a solidified structure, spraying the molten aluminum alloy from a nozzle, spraying solid particles of silicon in an amount corresponding to the remainder of the silicon contained in the aluminum alloy by gas jet simultaneously with spraying of the aluminum alloy, and depositing and cooling both the sprayed aluminum alloy and the sprayed solid particles of silicon.

According to the first aspect, the molten aluminum alloy sprayed from the nozzle contains silicon in such an amount that the solidified structure generates no large primary crystals of silicon. Such a silicon content depends on a cooling rate for the sprayed molten alloy and the like. The conventional I/M method tends to crystallize large primary crystals of silicon when the silicon content exceeds 12 percent by weight. On the other hand, the spray forming method employed in the present invention tends to crystallize large primary crystals of silicon when the silicon content exceeds 17 percent by weight, depending on the solidification rate and the like, as described above.

According to the first aspect of the present invention, the molten alloy sprayed from the nozzle contains silicon in such an amount that the solidified structure generates no large primary crystals of silicon, whereby it is possible to attain high strength and toughness with no crystallization of large primary crystals of silicon in the as-formed alloy. Dissimilarly to the general alloy powder extrusion method, not all silicon particles are contained in the alloy as alloy components, and hence the melting temperature of the alloy is not high and no problem such as plugging is caused in the nozzle. Further, the alloy produced by the spray forming method is rapidly cooled to cause only little reaction with oxygen. Also in this point, therefore, it is possible to obtain an alloy which is excellent in strength and toughness.

Silicon, which is in the amount corresponding to the remainder of that contained in the molten alloy, is sprayed in the form of solid particles by gas jet, and deposited with the molten alloy to be contained in the as-formed aluminum base alloy. It is possible to produce an aluminum alloy containing high concentration of silicon by spraying and depositing such solid particles of silicon. Further, the particle sizes of the silicon particles contained in the aluminum base alloy can be easily adjusted by controlling the particle sizes of the sprayed silicon particles.

According to the present invention, silicon which is soluble in aluminum is deliberately sprayed in the form of solid particles and mixed into the aluminum alloy. Thus, it is possible to produce an aluminum base alloy having a high content of silicon without increasing the melting temperature of the aluminum alloy.

According to the first aspect of the present invention, it is possible to easily produce an aluminum base alloy having a high content of silicon while maintaining the melting temperature of the aluminum alloy at a low level and preventing the spray nozzle from plugging and the like. In the as-formed aluminum base alloy, bonding at the interfaces between the silicon particles and the aluminum alloy forming a matrix is excellent as compared with the conventional pre-mixed powder extrusion method, whereby the thermal expansion coefficient of the aluminum base alloy can be reduced. Further, no large primary crystals of silicon are crystallized in the solidified structure, whereby it is possible to obtain an aluminum base alloy which is excellent in strength, toughness and machinability. Thus, the aluminum base alloy produced according to the present invention can be applied to a heat sink for a microwave electronic device, a package component, a wear-resistant component, or the like.

According to a second aspect of the present invention, produced is an aluminum base alloy containing silicon, in which graphite particles are dispersed. According to the second aspect, the method of the present invention comprises the steps of melting an aluminum alloy, spraying the molten aluminum alloy from a nozzle, spraying solid particles of silicon and graphite particles by gas jet simultaneously with spraying of the aluminum alloy, and depositing and cooling the sprayed aluminum alloy with the sprayed solid particles of silicon and graphite particles.

In the second aspect of the present invention, the solid particles of silicon and the graphite particles are preferably sprayed in heated states.

In the method according to the second aspect of the present invention, the molten aluminum alloy is sprayed and deposited with the silicon particles and the graphite particles. Therefore, the aluminum alloy is deposited in a semi-solidified state, so that the silicon particles and the graphite particles, which are solid particles, will not be unevenly distributed due to difference in specific gravity, dissimilarly to the conventional I/M method.

The sprayed aluminum alloy is rapidly solidified at a solidification rate of greater than $10^3$ k/sec., and hence the graphite particles are in contact with the aluminum alloy for a period of not more than 100/1000 sec. in a high temperature state. Thus, it is possible to suppress reaction between the aluminum alloy and the graphite particles at the interfaces thereof.

Dissimilarly to the conventional powder metallurgy method, particles of a completely molten aluminum alloy are sprayed and compounded with the silicon particles and the graphite particles, whereby high bonding strength can be attained between the matrix and the solid particles.

Further, strength of the matrix alloy can be increased since the same is rapidly solidified as described above. In addition, it is possible to suppress the amount of oxygen contained in the aluminum alloy to not more than 100 p.p.m. since the aluminum alloy is in contact with a small amount of oxygen contained in the atmosphere only for a short period.

One of the features of the second aspect is that not only graphite particles, which are infusible in an aluminum alloy, but also silicon, which is fusible in the aluminum alloy, are sprayed in states of solid-phase silicon particles and dispersed in the aluminum alloy. Therefore, it is possible to make the aluminum base alloy contain silicon without fusing silicon in the aluminum alloy, in order to improve wear resistance or reduce the thermal expansion coefficient. Thus, also when an aluminum alloy No. 2424 or 6061 according to American Aluminum Standards (AA) is employed, it is possible to improve the Young's modulus and the thermal expansion coefficient by compounding silicon while maintaining original characteristics of the employed alloy.

It is known that an aluminum alloy containing about 12% of silicon exhibits the lowest melting temperature. A large amount of silicon can be contained by adding 12% of silicon to an aluminum alloy to be melted for obtaining an alloy having a low melting temperature, and spraying solid-phase particles of silicon in an amount corresponding to the remainder with the aluminum alloy. The melting temperature of the aluminum alloy to be melted is reduced by such addition of silicon, thereby suppressing plugging of the spray nozzle etc. Further, it is also possible to suppress reaction at the interfaces between the aluminum alloy and the graphite particles by reducing the temperature.

According to the second aspect, further, the particles are successively deposited in the direction of thickness and cooled to produce an aluminum base alloy. Thus, it is possible to produce a material having different contents in the direction of thickness by either continuously or stepwisely changing the rate of addition of the sprayed graphite particles and silicon particles etc.

In the conventional I/M and P/M methods, the sizes of silicon particles contained in the alloys are determined by conditions such as cooling rates, and hence it is difficult to control the sizes of the particles which are present in the aluminum alloys. According to the present invention, on the other hand, it is possible to appropriately control the particle sizes of supplied silicon particles. When high wear resistance is required, for example, it is possible to mix/add a small amount of silicon particles having large particle sizes.

In the second aspect of the present invention, it is preferable to spray silicon particles and graphite particles in heated states with molten particles of an aluminum alloy. It is possible to remove gas components such as moisture adsorbed by the surfaces of the particles by heating the silicon particles and the graphite particles. Thus, the interfaces are cleaned and strongly bonded to the aluminum alloy.

According to the second aspect of the present invention, it is possible to produce an aluminum base alloy containing silicon, which has high strength, high rigidity and a low thermal expansion coefficient as well as excellent anti-sticking force, slidability and wear resistance by homogeneously dispersing graphite particles. Thus, the present invention is effectively applied to an aluminum base alloy which is employed for engine and mission parts for an automobile, home appliance components, office automation equipment, industrial equipments, a robot, or the like.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
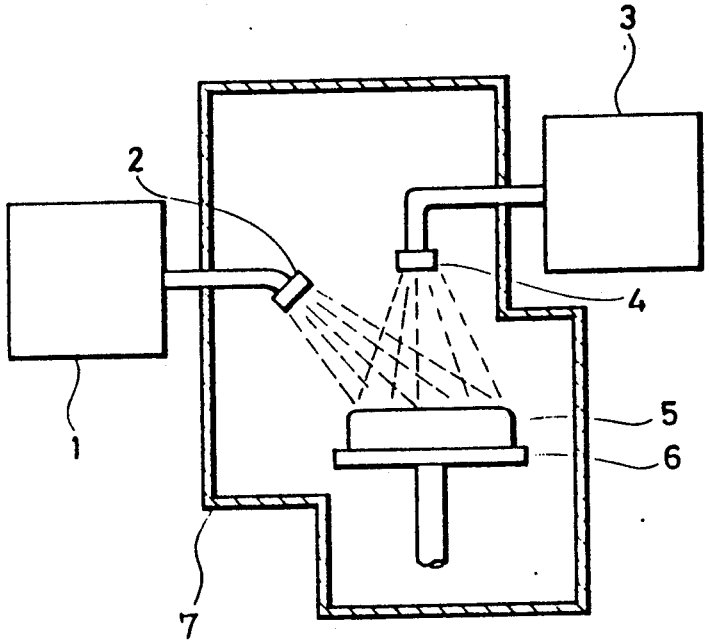
FIG. 1 is a schematic block diagram showing an apparatus for illustrating an exemplary method of producing an aluminum base alloy according to the present invention.

Referring to FIG. 1, an aluminum alloy melting/-spraying apparatus 1 is provided along an upper portion of a spray chamber 7. The aluminum alloy melting/-spraying apparatus 1 is provided with a spray nozzle 2 for spraying molten particles of an aluminum alloy into the interior of the spray chamber 7. A spray unit 3 provided along another upper portion of the spray chamber 7 for spraying solid particles such as silicon particles. When graphite particles are sprayed with silicon particles, these particles are sprayed by the spray unit 3. The spray unit 3 is provided with a spray nozzle 4 for spraying the solid particles into the interior of the spray chamber 7. A support 6 is provided in a lower portion of the spray chamber 7. The molten particles of the aluminum alloy sprayed from the spray nozzle 2 and the solid particles sprayed from the spray nozzle 4 are deposited on the support 6, to define a deposition billet 5.

The support 6 is downwardly moved as the thickness of the deposition billet 5 is increased by deposition so that the upper portion of the deposition billet 5 is regularly maintained at the same level. Further, the support 6 is horizontally swung or rotated in FIG. 1 to attain homogeneous deposition in the deposition plane.

Figure 2:
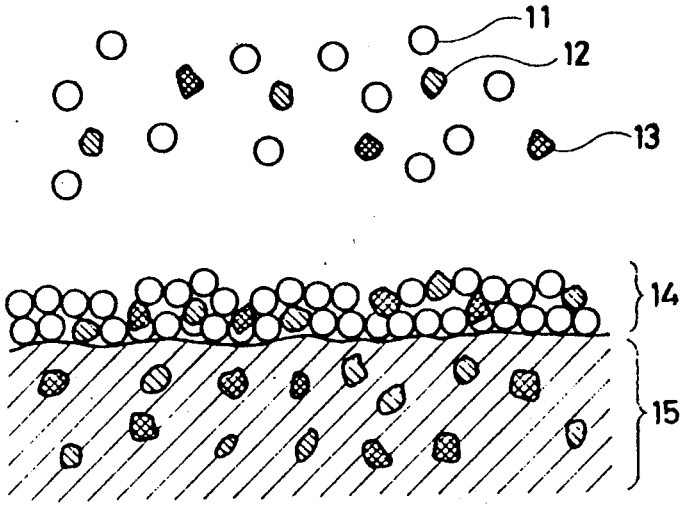
FIG. 2 is a sectional view showing a state of deposition in the method according to the present invention.

FIG. 2 is a sectional view showing a state of deposition particularly in accordance with the second aspect of the present invention. Referring to FIG. 2, molten particles 11 of an aluminum alloy are sprayed with silicon particles 12 and graphite particles 13. Then the molten particles 11 of the aluminum alloy are deposited with the silicon particles 12 and the graphite particles 13, and rapidly solidified to define a semi-solidified phase 14. In this case, the surfaces of the silicon particles 12 are extremely slightly molten in the aluminum alloy. While the graphite particles 13 come into contact with the molten particles 11 of the aluminum alloy, substantially no reaction is caused between the graphite particles 13 and a matrix of the aluminum alloy since the molten particles 11 of the aluminum alloy are rapidly solidified. The particles are cooled with further progress of deposition, to define a complete solidified phase 15.

The apparatus shown in FIG. 1 was used to produce samples of an aluminum base alloy containing silicon according to the present invention.

EXAMPLE I

Example I according to the first aspect of the present invention is now described.

Aluminum alloys respectively containing 35 percent by weight, 45 percent by weight and 55 percent by weight of silicon were prepared. Aluminum alloys each containing 15 percent by weight of silicon were first prepared, and melted and sprayed from nozzles.

Silicon particles of 3 μm in mean particle size were prepared to be deposited with the molten alloys. The silicon particles were sprayed by gas jet in amounts corresponding to the remainders of those contained in the molten alloys, i.e., 20 percent by weight, 30 percent by weight and 40 percent by weight respectively, and deposited with the molten alloys.

Table 1 shows thermal expansion coefficients of the as-formed aluminum base alloys.

For the purpose of comparison, an Al - 35 wt. % Si alloy, an Al - 45 wt. % alloy and an Al - 55 wt. % Si alloy were prepared by the conventional alloy powder extrusion method and the mixed powder extrusion method respectively. Table 1 also shows the thermal expansion coefficients of these samples.

TABLE 1

| | Thermal Expansion Coefficient ($\times 10^{-6}$/°C.) | | |
|---|---|---|---|
| | According to the present invention Method | Pre-Alloy Powder Extrusion Method | Pre-Mixed Powder Extrusion Method |
| Al-35 wt. % Si | 13.9 | 13.8 | 15.5 |
| Al-45 wt. % Si | 11.7 | 11.9 | 14.4 |
| Al-55 wt. % Si | 10.0 | 9.9 | 14.0 |

As clearly understood from Table 1, the thermal expansion coefficients of the aluminum base alloys obtained according to the present invention are similar to those of the samples according to the conventional alloy powder extrusion method. It has been verified that the aluminum base alloys obtained according to the method of the present invention are equivalent to the samples according to the alloy powder extrusion method also in strength, toughness and machinability.

It has been confirmed that the aluminum base alloys obtained according to the method of the present invention have lower thermal expansion coefficients than the samples obtained by the conventional mixed powder extrusion method, and the silicon particles are sufficiently joined with matrices at the interfaces therebetween in the aluminum alloys obtained according to the method of the present invention. The melting temperatures of the Al - 35 wt. % Si alloy, the Al - 45 wt. % Si alloy and the Al - 55 wt. % Si alloy obtained according to the alloy powder extrusion method were 950° C., 1000° C. and 1050° C. respectively. On the other hand, the melting temperature of the Al - 15 wt. % Si alloy obtained according to the method of the present invention was 650° C. The aluminum base alloy according to the first aspect of the present invention can be treated as an alloy having a lower melting temperature, and the method is simpler than the conventional alloy powder extrusion method.

EXAMPLE II

Examples according to the second aspect of the present invention are no described.

EXAMPLE II-1

An aluminum alloy 336.0 according to American Aluminum Standards (AA/ASTM), containing 12% of silicon, was melted and particles thereof were sprayed with silicon powder of 3 μm in mean particle size and graphite particles of 6 μm in mean particle size. Thus produced was an aluminum base alloy having final composition ratios of Al - 20% Si - 5% Gr (graphite particles). In relation to this Example and the following Examples, symbol % denotes percent by weight.

EXAMPLE II-2

An aluminum alloy No. 2024 according to American Aluminum Standards was melted and sprayed with silicon powder of 3 μm in mean particle size and graphite particles of 6 μm in mean particle size, to produce an aluminum base alloy having final composition ratios of Al - 25% Si - 1% Gr.

EXAMPLE II-3

An aluminum alloy No. 6061 according to AA-/ASTM was melted, sprayed with silicon powder of 3 μm in mean particle size and graphite particles of 6 μm in mean particle size, and deposited. Thus produced was an aluminum base alloy having final composition ratios of Al - 35% Si - 2% Gr.

EXAMPLE II-4

An aluminum alloy A-390 according to ASTM was employed and sprayed with silicon particles of 3 μm in mean particle size and graphite particles of 6 μm in mean particle size, and deposited. Thus produced was an aluminum base alloy having final composition ratios of Al - 22% Si - 5% Gr.

REFERENCE EXAMPLE II-1

Atomized powder of an aluminum alloy A-390 according to ASTM was mixed with graphite particles of 5 μm in mean particle size. The mixed powder was extruded in an extrusion ratio of 10:1, to produce an aluminum base alloy of A-390 composition +5% Gr.

REFERENCE EXAMPLE II-2

Alloy powder of Al - 35% Si - 3% Cu - 0.5% Mg was extruded in an extrusion ratio of 10:1, to produce an aluminum base alloy.

Table 2 shows values of tensile strength, thermal expansion coefficients, Young's moduli, amounts of specific abrasion loss, values of anti-sticking force and values of fracture toughness ($K_{IC}$) of the aluminum base alloys according to Examples II-1 to II-4 and Reference Examples II-1 and II-2.

The amounts of specific wear loss were measured by the Ohgoshi's method under conditions of 2 m/s. As to Reference Examples II-1 and II-2 obtained by extrusion, the amounts of specific abrasion loss were measured along the longitudinal directions.

Figure 3:
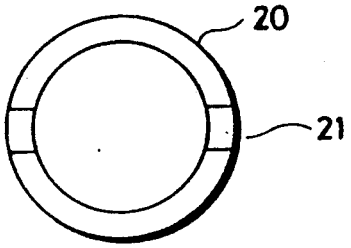
FIG. 3 is a front elevational view showing the configuration of each sample used for measuring anti-sticking force in Example of the present invention.
Figure 4:
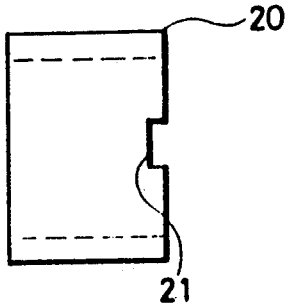
FIG. 4 is a side elevational view showing the configuration of each sample used for measuring anti-sticking force in Example of the present invention.

FIGS. 3 and 4 are a front elevational view and a side elevational view showing a cylindrical sample 20 which was prepared for measuring anti-sticking force of each samples. As shown in FIGS. 3 and 4, a groove 21 is formed on one side of the sample 20. This cylindrical sample 20 has an outer diameter of 25.6 mm and an inner diameter of 20.0 mm. The groove 21 is 6.0 mm long and 3 mm deep. The height of this cylinder is 15 mm.

Figure 5:
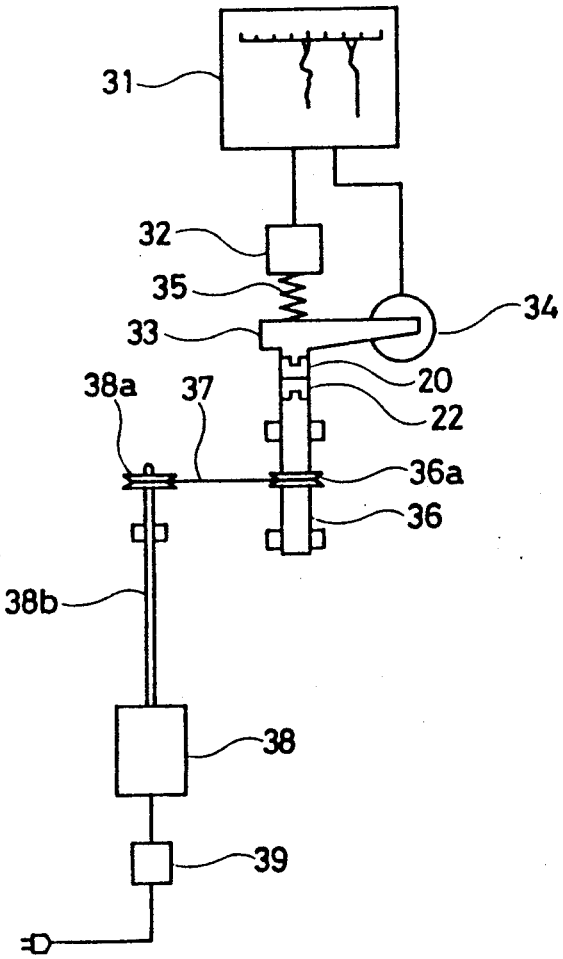
FIG. 5 is a schematic block diagram showing an apparatus employed for measuring anti-sticking force in Example of the present invention.

FIG. 5 shows an apparatus for measuring anti-sticking force of such samples. Samples 20 and 22 are mounted as shown in FIG. 5 so that surfaces provided with no grooves face each other. The sample 22 is similar in size and configuration to the sample 20. This sample 22 is mounted on a rotary shaft 36, so that a projecting part of the rotary shaft 36 is engaged with the groove of the sample 22. A pulley **36*a* is engaged with the rotary shaft 36. Another pulley 38*a* is also engaged with another rotary shaft 38*b* of a DC motor 38, and a V belt 37 is extended between this pulley 38*a* and the pulley 36*a* of the rotary shaft 36. The rotating speed of the DC motor 38 is continuously set/varied by an SCR unit 39**.

A torque bar 33 is engaged with the sample 20, whose sliding face is in contact with the upper surface of the sample 22. A load cell 34 for measuring frictional force is mounted on one end of the torque bar 33, and a signal detected by the load cell 34 for measuring frictional force is indicated/recorded by a recorder 31. Another load cell 32 for measuring pressurizing force is mounted on the torque bar 33 through a pressurizing spring 35. The recorder 31 also indicates/records pressurizing force which is detected by the load cell 32 for measuring pressurizing force. The pressurizing spring 35 is adapted to stably pressurize the samples 20 and 22 so that no change is caused in the pressurizing load which is applied to the samples 20 and 22 upon sliding thereof.

In the apparatus having the aforementioned structure, the rotational speed of the rotary shaft 36 is set so that the peripheral speed at the sample surfaces is 200 m/sec., and the pressurizing load applied between the samples 20 and 22 is stepwisely changed. Sliding frictional force acting between the samples 20 and 22 is changed by such change of the pressurizing load. The load cell 34 for measuring frictional force detects the changed sliding frictional force. The pressurizing load acting between the samples 20 and 22 is so stepwisely changed as to detect a value causing abrupt increase of the sliding frictional force as anti-sticking force.

TABLE 2

| | Tensile Strength ($kgf/mm^2$) | Thermal Expansion Coefficient ($\times 10^{-6}/K$) | Young Modulus ($\times 10^3$ $kgf/mm^2$) | Specific Wear Loss ($\times 10^{-7}$ $mm^2/kg$) | Anti-Sticking Force (kg) | $K_{1c}$ |
|---|---|---|---|---|---|---|
| Example | | | | | | |
| II-1 | 40 | 18.2 | 8.5 | 4.2 | 300 | 29 |
| II-2 | 44 | 16.4 | 9.2 | 3.5 | 260 | 25 |
| II-3 | 38 | 14.2 | 10.5 | 3.0 | 280 | 21 |
| II-4 | 41 | 17.0 | 8.8 | 3.8 | 310 | 24 |
| Reference Example | | | | | | |
| II-1 | 40 | 18.6 | 8.4 | 8.3 | 260 | 19 |
| II-2 | 43 | 13.8 | 10.7 | 4.2 | 150 | 17 |

As clearly understood from Table 2, the aluminum base alloys produced according to Examples II-1 to II-4 of the present invention are extremely superior to those according to Reference Examples II-1 and II-2 in specific abrasion loss, anti-sticking force and fracture toughness.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of producing an aluminum base alloy containing silicon, comprising the steps of:

melting an aluminum alloy;

spraying said molten aluminum alloy from a nozzle;

spraying solid particles of silicon by gas jet simultaneously with said spraying of said aluminum alloy; and depositing and cooling both said sprayed aluminum alloy and said sprayed solid particles of silicon.

2. A method in accordance with claim 1, wherein said solid particles of silicon are not more than 10 μm in mean particle size.

3. A method of producing an aluminum base alloy containing at least 17 percent by weight of silicon, comprising the steps of:

melting an aluminum alloy containing silicon in an amount not generating primary crystals of silicon in a solidified structure;

spraying said molten aluminum alloy from a nozzle;

spraying solid particles of silicon in an amount corresponding to the amount of silicon to be contained in the aluminum base alloy minus the amount of silicon in said molten aluminum alloy, by gas jet simultaneously with said spraying of said aluminum alloy; and depositing and cooling both said sprayed aluminum alloy and said sprayed solid particles of silicon.

4. A method of producing an aluminum base alloy containing silicon with graphite particles being dispersed therein, comprising the steps of:

melting an aluminum alloy;

spraying said molten aluminum alloy from a nozzle;

spraying solid particles of silicon and graphite particles by gas jet simultaneously with said spraying of said aluminum alloy; and depositing and cooling both said sprayed aluminum alloy and said sprayed solid particles of silicon and graphite particles.

5. A method in accordance with claim 4, wherein said solid particles of silicon and said graphite particles are sprayed in heated states.

* * * * *